US006375040B1

(12) United States Patent
Allanson et al.

(10) Patent No.: US 6,375,040 B1
(45) Date of Patent: Apr. 23, 2002

(54) DISPOSABLE STORAGE AND DISPENSING CARAFE

(75) Inventors: Gary R. Allanson, Millersville, MD (US); Ann Marie Sullivan, Waltham, MA (US); Thomas C. Merle, Ashland, MA (US); John A. MacNeil, Melrose, MA (US); John Gundlach, Acton, MA (US); John Costello, Wellesley, MA (US)

(73) Assignee: International Dispensing Corporation, Millersville, MD (US)

( * ) Notice: Subject to any disclaimer, the term of this patent is extended or adjusted under 35 U.S.C. 154(b) by 0 days.

(21) Appl. No.: 09/782,827

(22) Filed: Feb. 13, 2001

Related U.S. Application Data

(60) Provisional application No. 60/237,517, filed on Oct. 4, 2000.

(51) Int. Cl.[7] ..... B65D 35/56

(52) U.S. Cl. ..... 222/105; 222/183

(58) Field of Search ..... 222/105, 183, 222/131, 466, 465.1; 220/495.96, 62.21

(56) References Cited

U.S. PATENT DOCUMENTS

| | | | | |
|---|---|---|---|---|
| 601,877 A | | 4/1898 | Lochmann | |
| 2,574,931 A | | 11/1951 | Nason, Jr. | |
| 2,618,409 A | | 11/1952 | Eisenberger et al. | |
| 3,143,249 A | | 8/1964 | Merrill et al. | |
| 3,163,544 A | | 12/1964 | Valyi | |
| 3,227,322 A | | 1/1966 | Crain | |
| 3,233,817 A | | 2/1966 | Casady | |
| 3,363,807 A | | 1/1968 | Powell | |
| 3,931,916 A | | 1/1976 | Blue et al. | |
| 4,197,890 A | | 4/1980 | Simko | |
| 4,375,864 A | | 3/1983 | Savage | |
| 4,383,635 A | | 5/1983 | Yotoriyama | |
| 4,653,671 A | | 3/1987 | Duffy et al. | |
| 4,747,703 A | | 5/1988 | Cazes | |
| 4,781,314 A | | 11/1988 | Schoonover et al. | |
| 4,979,628 A | | 12/1990 | Robbins, III | |
| 5,048,691 A | | 9/1991 | Heuberger et al. | |
| 5,125,566 A | | 6/1992 | Deiger | |
| 5,163,485 A | | 11/1992 | Hermann | |
| 5,169,019 A | | 12/1992 | Budenbender | |
| 5,176,294 A | * | 1/1993 | Della Riva | 222/105 |
| 5,392,958 A | | 2/1995 | Kurtzahn et al. | |
| 5,474,212 A | | 12/1995 | Ichikawa et al. | |
| 5,638,989 A | * | 6/1997 | Ophardt et al. | 222/105 |
| 5,715,992 A | | 2/1998 | Andrews, Sr. et al. | |
| 5,731,021 A | | 3/1998 | Spector | |
| 5,904,267 A | | 5/1999 | Thompson | |
| 5,909,841 A | | 6/1999 | Andrews, Sr. et al. | |
| 5,931,583 A | | 8/1999 | Collie | |
| 5,941,421 A | | 8/1999 | Overman et al. | |
| 5,967,370 A | * | 10/1999 | Nettles et al. | 222/105 |
| 5,979,685 A | | 11/1999 | Schutz | |
| D419,028 S | | 1/2000 | Mork et al. | |
| 6,062,434 A | * | 5/2000 | Melk | 222/183 |
| 6,116,467 A | * | 9/2000 | Petriekis et al. | 222/105 |
| 6,209,781 B1 | | 4/2001 | Sylvester et al. | |

* cited by examiner

*Primary Examiner*—Philippe Debakshani
*Assistant Examiner*—Thach H. Bui
(74) *Attorney, Agent, or Firm*—Whiteford, Taylor & Preston L.L.P.; Gregory M. Stone. Esq.

(57) ABSTRACT

An improved disposable storage and dispensing carafe which allows the easy transport and dispensing of a bulk volume of a hot or cold liquid in a throw-away container. The carafe comprises a rigid frame having a dispensing outlet, a pliable or plastic bag for holding a hot or cold liquid having a rigid spout affixed thereto, means for detachably connecting the rigid spout to the dispensing outlet, and an insulating jacket detachably connected to the frame and enveloping the pliable or plastic bag.

19 Claims, 7 Drawing Sheets

DISPOSABLE STORAGE AND DISPENSING CARAFE

CROSS-REFERENCE TO RELATED APPLICATIONS

The present application is based upon and gains priority from U.S. Provisional Patent Application Ser. No. 60/237,517, filed Oct. 4, 2000 by the inventors herein and entitled "Disposable Storage and Dispensing Caraffe."

BACKGROUND OF THE INVENTION

1. Field of the Invention

The invention disclosed herein relates generally to beverage carafes, and more particularly to an improved disposable storage and dispensing carafe which allows the easy storage, transport and dispensing of a bulk volume of a hot or cold beverage in a throw-away container.

2. Description of the Background

Many food product retailers and food service providers offer their customers carry-out hot or cold beverages. The incremental sales of such hot or cold beverages provide a significant profit margin for such product and service suppliers. However, for the consumer purchasing such hot or cold beverages, a significant safety and product quality challenge exists in transporting volumes in excess of what would be consumed by a single consumer. From a safety perspective, while cardboard trays have been provided in the past to help a consumer transport up to four cups containing a hot or cold beverage, the transport of more than four cups is impractical and presents a safety risk of spilling the beverage and even possibly causing bums to the person carrying the beverages. Moreover, from a product quality perspective, the transport of a tray of multiple hot beverage containers is inclined to cool the beverages much more quickly than would a large volume insulated thermos or carafe. Unfortunately, however, the costs of traditional thermoses or carafes makes their sale as a container for a hot or cold beverage sold in a traditional carry-out or catering business setting highly impractical.

Still further, providing large volume containers for carry-out beverages creates a significant packaging and storage challenge, in that large volume carafes and thermoses take up large amounts of physical space both in shipping vehicles and in storage facilities at retail locations, making their widespread use even more impractical. While nock-down, folded cardboard containers have been used in the past, the use of such a non-rigid material precludes its use for carrying large volumes of a hot or cold beverage (e.g., up to 108 ounces/6 pounds) at one time).

Thus, there is a need in the art for a disposable storage and dispensing carafe which can safely transport and dispense a bulk volume (preferably at least 108 ounces) of a hot or cold beverage and which may be manufactured at sufficiently low cost to enable the carafe to be disposed of after use, and which is collapsible so as to allow easy transport to and storage at a retail establishment or the like.

SUMMARY OF THE INVENTION

It is, therefore, an object of the present invention to provide a cost efficient, disposable storage and dispensing carafe which avoids the disadvantages of the prior art.

It is another object of the present invention to provide a disposable storage and dispensing carafe which enables easy, safe dispensing of the contents of the carafe.

It is yet another object of the present invention to provide a disposable storage and dispensing carafe having an insulated exterior to maintain the temperature of the carafe contents and to protect persons and objects from inadvertent bums from contacting a stored hot beverage.

It is still yet another object of the present invention to provide a disposable storage and dispensing carafe having a rigid first means for manually transporting the carafe, and a rigid second means for dispensing the carafe contents.

It is still even yet another object of the present invention to provide a disposable storage and dispensing carafe having a rigid frame with a readily replaceable fluid content carrier.

In accordance with the above objects, a disposable storage and dispensing carafe is disclosed which enables the easy transport and dispensing of a large volume (preferably at least 96 to 128 fluid ounces) of a liquid without risk of bum or spillage of the carafe contents. The carafe comprises a rigid, generally rectangular frame having a dispensing outlet at its upper end, an insulated, waterproof, generally pliable or plastic bag for holding the fluid to be dispensed at up to 250° F. and having an opening at its upper end, a rigid spout affixed to the plastic bag at its opening, and means on the rigid spout for attaching the spout to the dispensing outlet of the frame. The frame is also provided a handle having a carrying portion and a dispensing portion. Insulating material preferably in the form of a corrugated paperboard jacket is connected to the frame about the pliable or plastic bag after it is positioned within the frame.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
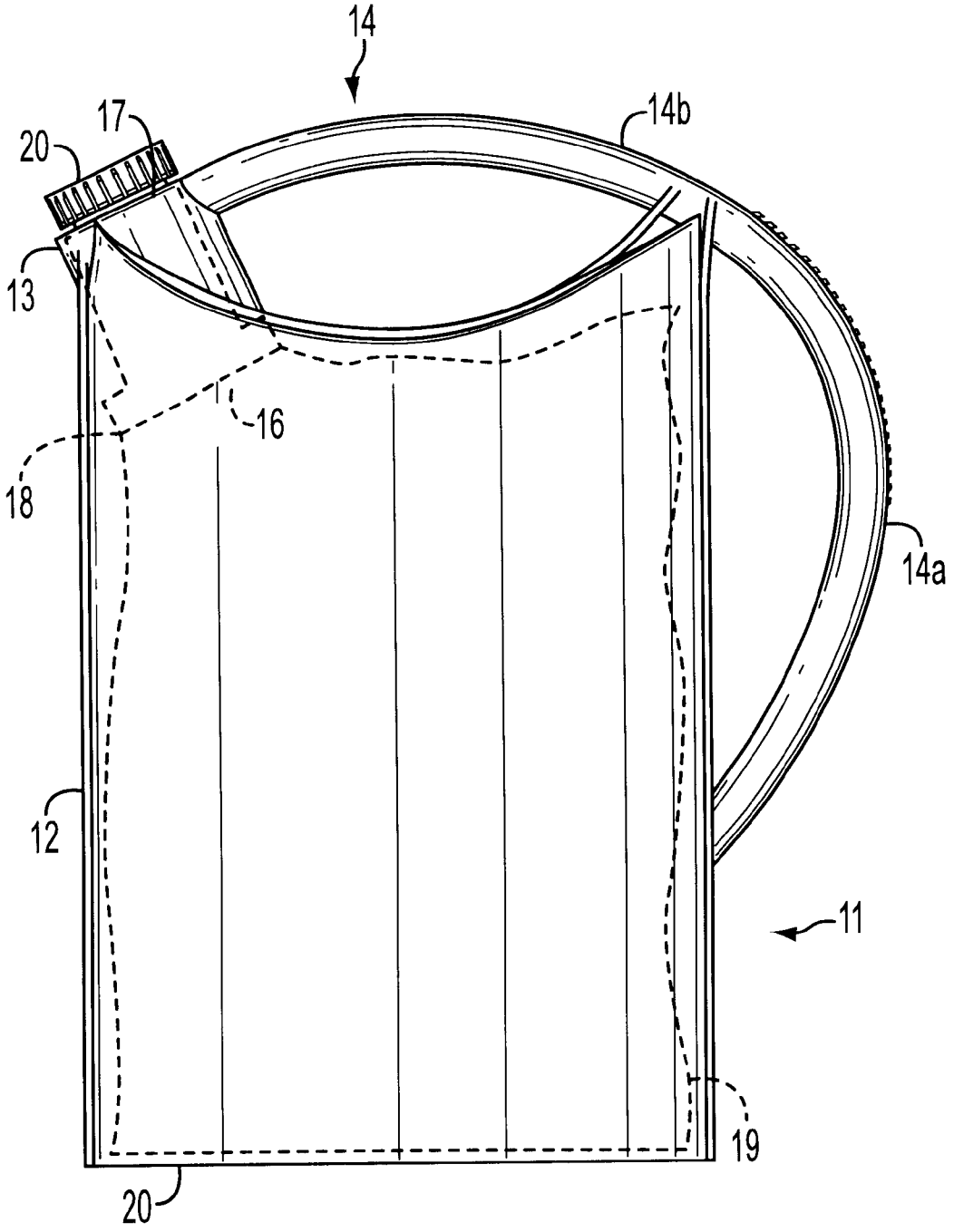
FIG. 1 is a side view of a beverage carafe of the instant invention.

As shown in the side view of FIG. 1, the beverage carafe of the instant invention comprises a rigid frame (shown generally at 11) having a support member 12, a spout holder 13 positioned at the top of support member 12, and a handle 14. While handle 14 is denoted in FIG. 1 as a single elongate member, it should be noted that handle 14 particularly comprises a pouring handle member 14*a* and a carrying handle member 14*b*, and that such handle members may be provided as distinct rigid members without departing from the spirit and scope of the instant invention. An elongated, generally annular spout 15 having an inlet opening 16 and a dispensing outlet 17 is configured for insertion into spout holder 13. An insulated, waterproof, generally pliable or plastic bag 19 for holding the fluid to be dispensed is connected at its upper end to a heat seal connecting section 18 on spout 15 to form an integral unit therewith. Pliable bag 19 and annular spout 15 are so connected into the supporting assembly 12 of the frame 11 and the spout holder 13 that the dispensing outlet 17 of annular spout 15 will be disposed exterior of frame 11 to enable a cover 20, such as an internally threaded closure cap, to be detachably connected to annular spout 15 about dispensing outlet 17. Insulating material in the form of a jacket 20 is connected to the support assembly 12 about pliable bag 19 and spout holder 13 after the integral spout/bag unit is connected in assembled position on support assembly 12 of frame 11.

Figure 2A:
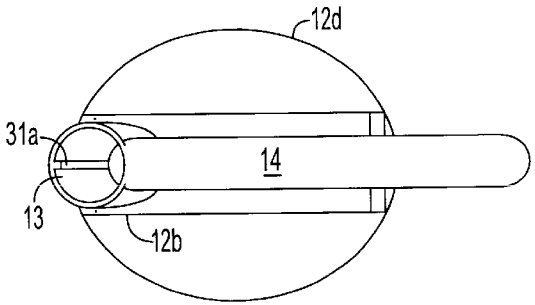
FIGS. 2*a*, 2*b*, and 2*c* are top, side, and rear views, respectively, of frame member 11.
Figure 2B:
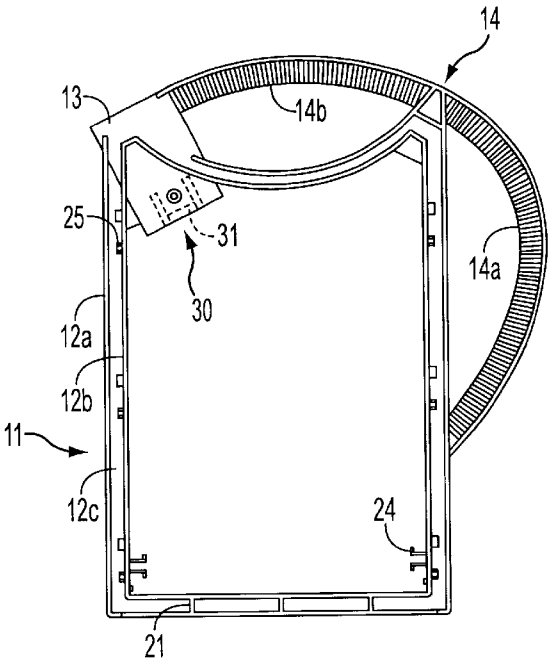
Figure 2C:
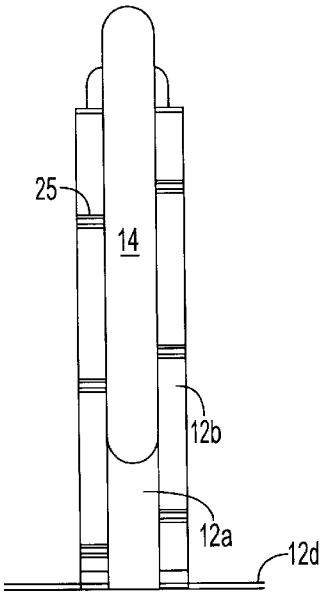

Referring next to the detailed top view, side view, and rear view of the frame of FIGS. 2*a*, 2*b*, and 2*c*, respectively, rigid frame 11 comprises support member 12, spout holder 13 positioned at the top of support member 12, and handle 14. Support member 12 more particularly comprises an internal, rigid, generally rectangular support member 12*b* circumscribed by an external, rigid, generally rectangular support member 12*a*. Support members 12*a* and 12*b* are interconnected via a planar web 12*c* extending between outer support member 12*a* and inner support member 12*b*, and at their bases via ribs 21. The uppermost section of support members 12*a* and 12*b* (as shown in FIG. 2*b*) may optionally be formed as a concave well extending into the area of the otherwise rectangular forms defined by support members 12*a* and 12*b*, but may likewise be formed as a generally horizontal surface, or a convex hump, without departing from the spirit and scope of the instant invention.

Figure 2D:
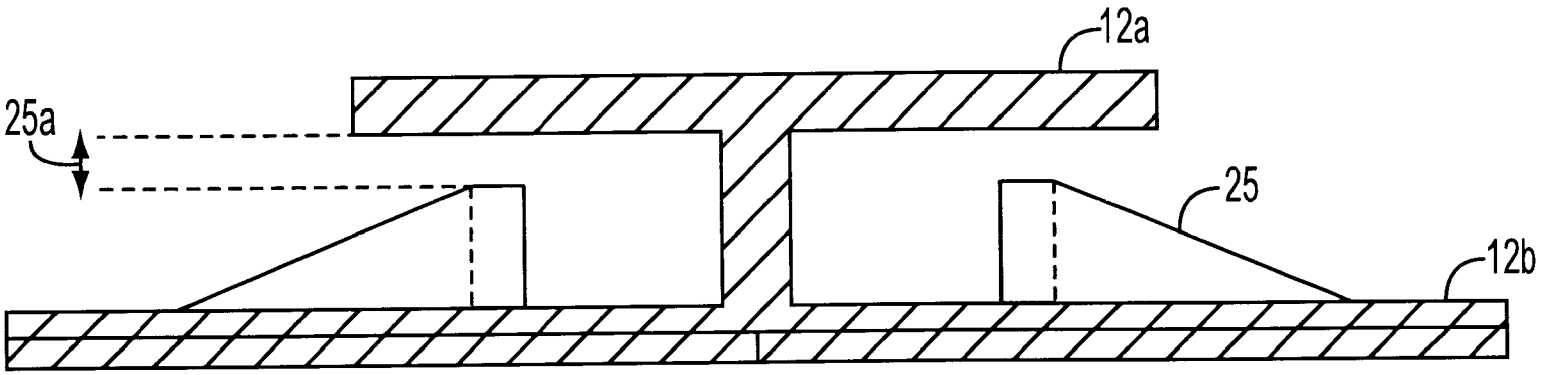
FIG. 2*d* is a top down, section view of a portion of frame member 11.

Internal support member 12*b* is preferably provided with a series of clamping means 25 for holding insulating sleeve 20 on frame 11, as will be discussed in greater detail below. As shown more particularly in the section view of the frame assembly of FIG. 2*d*, each clamping means 25 preferably comprises a ramp extending outward from the face of support member 12*b* towards the interior face of support member 12*a*, and defining a gap 25*a* between the top of clamping means 25 and the interior face of support member 12*a*. Likewise, t-shaped tabs 24 are rigidly affixed to the interior of support member 12*b* and are configured to receive flexible storage bag 19 and hold the same within frame 11, as explained in greater detail below.

As shown more particularly in FIGS. 2*a* and 2*c*, frame 11 is also provided a rigid, ovular, planar base member 12*d* integrally formed with the other portions of frame 11 and providing a broad, flat base on which the carafe assembly may rest when not in use.

Rigidly affixed to an upper corner of both support members 12*a* and 12*b* is spout holder 13. Spout holder 13 defines a generally annular passage extending from the interior of frame 11 to the exterior of frame 11. The wall of spout holder 13 is preferably segmented at is bottom in order to provide a tab (shown generally at 30) which, due to the inherent flexibility of spout holder 13 (which is preferably formed of polypropylene), may move slightly into and away from the annular passage defined by spout holder 13. The bottom portion of tab 30 is preferably provided a hook 30 for engaging a lip on annular spout 15 to hold annular spout 15 in place within spout holder 13, as will be described in greater detail below.

Spout holder 13 is also provided a guide flange 31*a* (FIG. 2*a*) running parallel to the major axes of spout holder 13 and attached to an interior wall thereof. Guide flange 31*a* is configured to mate with a guide channel 36 (FIGS. 4*a* and 4*c*) on spout 15 so as to ensure proper alignment of spout 15 when it is placed in spout holder 13.

Handle 14 extends outward from the upper edge of spout holder 13 towards an opposing upper corner of support member 12*a* where it intersects support member 12*a*, and down to a location below the midpoint of the rear portion of support member 12*a*. While the figures depict handle 14 as a generally rounded bar, it should be noted that any similarly configured elongate, rigid structure that intersects spout holder 13 and the top member of support member 12 to provide a handle for vertically transporting the beverage carafe would suffice and not depart from the spirit and scope of the instant invention. Likewise, any similarly configured elongate, rigid handle structure that provides a gripping means along the upper extent of the side member of support member 12 with a lower end attached below the midpoint of the rear portion of support member 12*a* so as to provide a handle for pouring the contents from the carafe while maintaining balanced control of the its contents would likewise suffice and not depart from the spirit and scope of the instant invention.

Rigid frame 11 is preferably formed of polypropylene, providing a light-weight structure of sufficient strength and rigidity to be able to support the weight of at least 108 fluid ounces of a beverage (i.e., at least 6 pounds).

Figure 3:
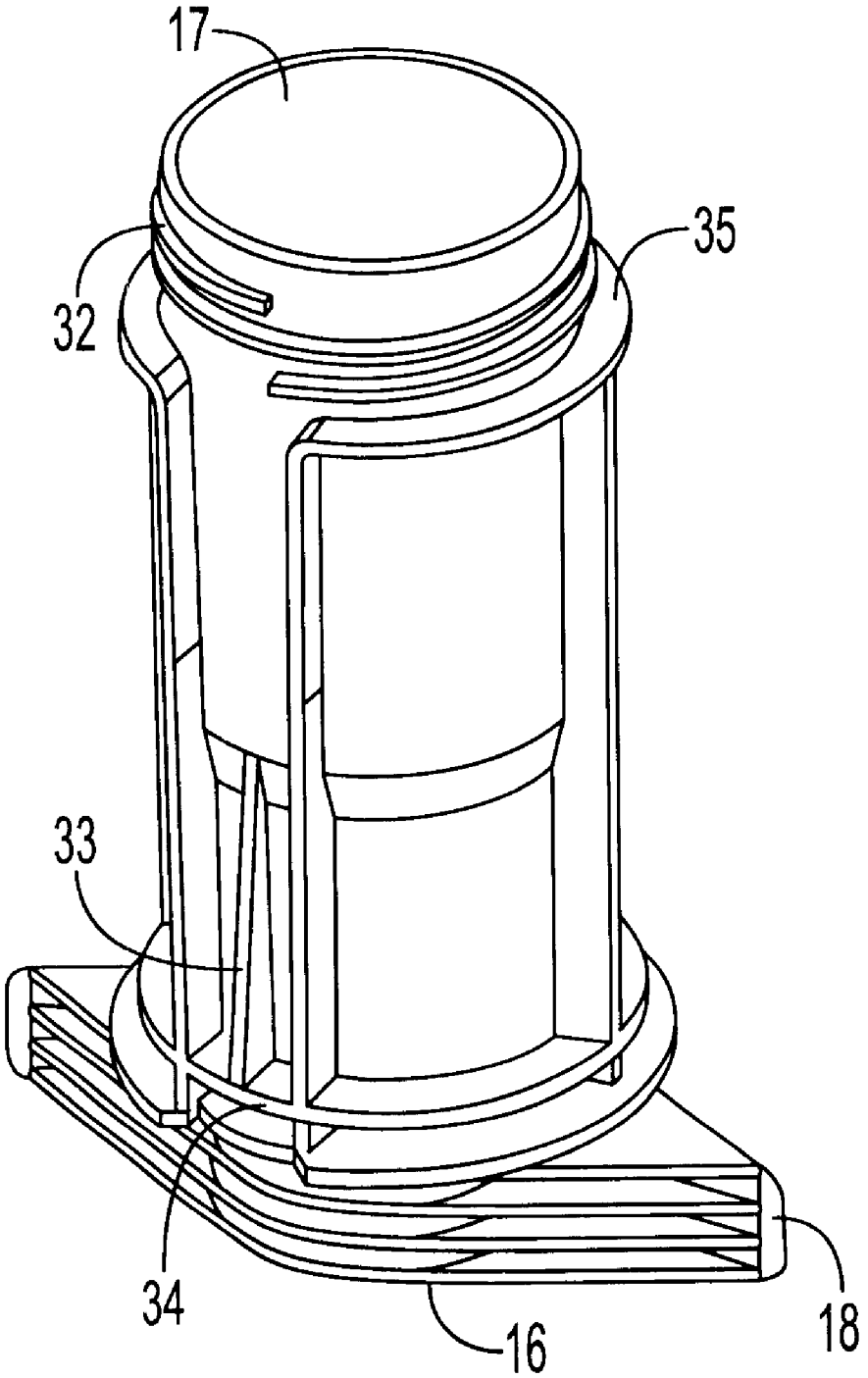
FIG. 3 is a side perspective view of spout 15.
Figure 4A:
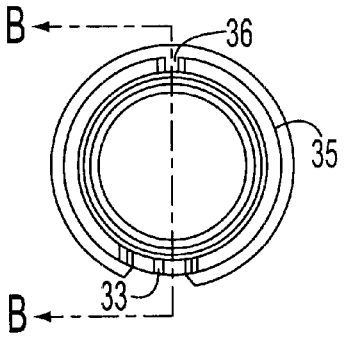
FIGS. 4*a*, 4*b*, and 4*c* are top, side, and sectional views, respectively, of spout 15.
Figure 4B:
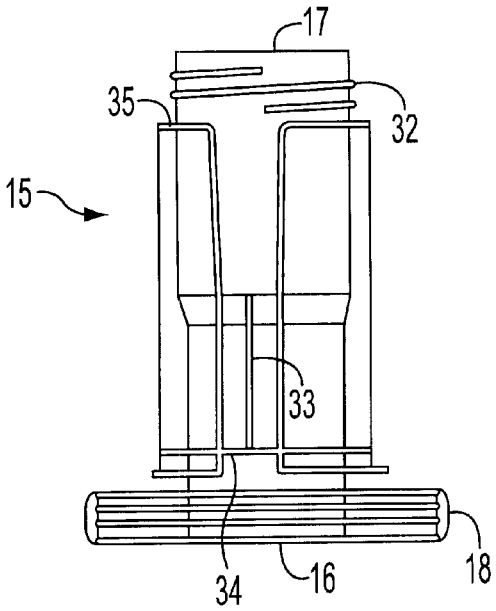
Figure 4C:
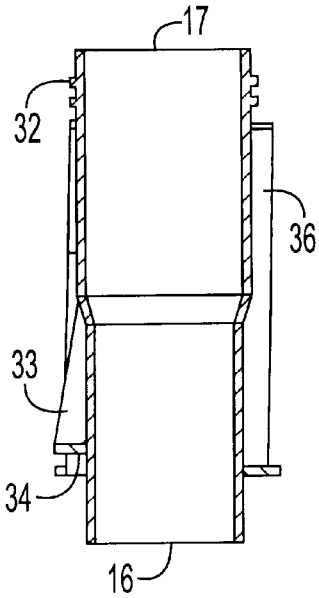

As shown in the perspective view of FIG. 3 and the detailed top, side, and sectional views of FIGS. 4*a*, 4*b*, and 4*c*, respectively, spout 15 comprises an elongated, generally annular shaft having an inlet opening 16 and a dispensing outlet 17, and is configured for insertion into spout holder 13 such that the uppermost portion of spout 15 extends above spout holder 13 when installed. The upper portion of spout 15 is provided with fastening means 32 preferably in the form of external threads circumscribing the outer circumference of the top portion of spout 15, the fastening means being configured to receive and fasten to spout 15 a closure 20 (FIG. 1) on the dispensing outlet 17 of spout 15 to prevent inadvertent spillage during transport. Spout 15 is preferably provided a guide flange 33 running parallel to the major axis of spout 15 along an outer wall thereof rising in height away from the external surface of spout 15 as it extends down the length of spout 15, and terminating in an abutment 34 formed as a ring circumscribing the exterior of spout 15 near its bottom end. Spout 15 is further preferably provided a guide channel 36 running parallel to the major axis of spout 15 along an outer wall thereof, such guide channel 36 being sized and configured to receive guide flange 31*a* (FIG. 2*a*) on spout holder 13 so as to align spout 15 as it is inserted into spout holder 13. When installing spout 15 in spout holder 13, spout 15 is inserted from the bottom portion of spout 15 and is pushed upwards (while being guided and aligned by guide channel 36 and guide flange 31*a*) until a top abutment 35 comes into contact with an interior ledge on spout holder 13 (not shown). As spout 15 is so inserted, hook 30 on tab 31 of spout holder 13 is guided by guide flange 33 and is thereby flexed outwardly from the center of spout holder 13, until hook 30 overpasses abutment 34 at which point tab 31 snaps back into its original, at-rest position, in turn locking spout 15 in spout holder 13 so as to prevent rearward movement of spout 15 back into the volume of the carafe. Spout 15 is also provided at its bottom with connecting section 18 for heat sealing, adhesively connecting, or otherwise attaching an empty plastic bag 19 thereto, as discussed in greater detail below.

Figure 5:
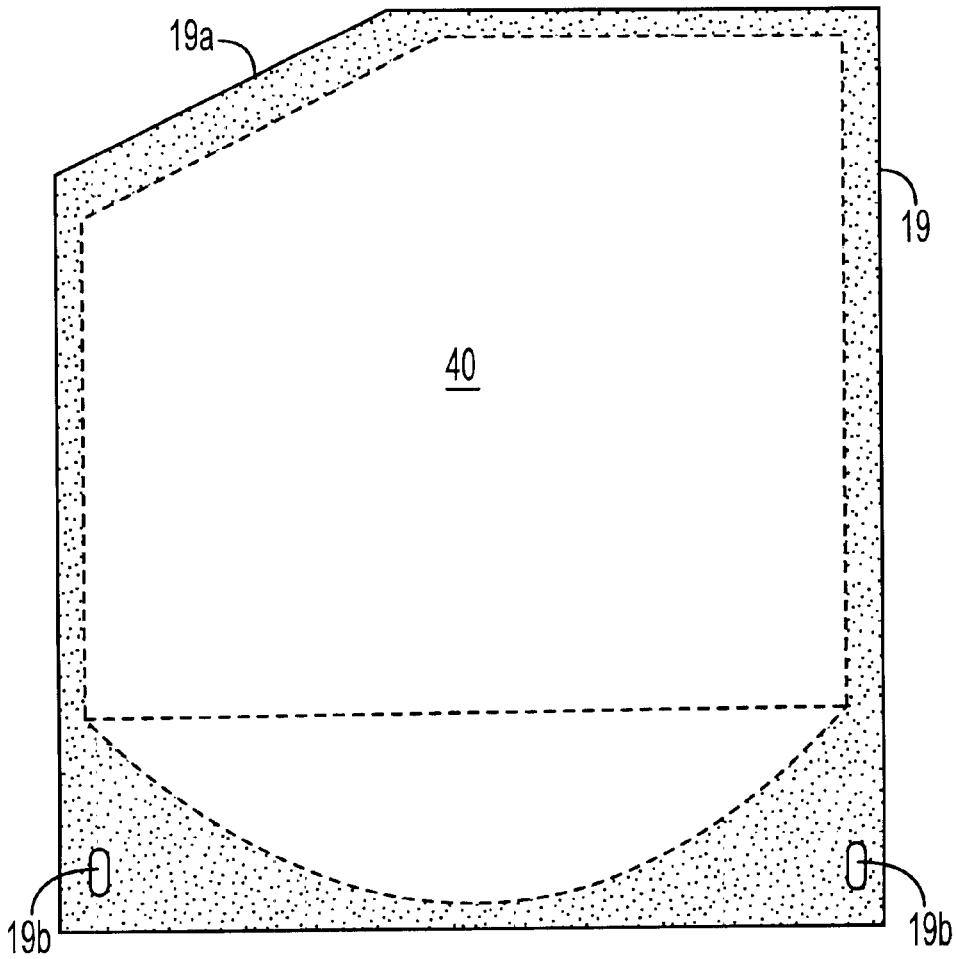
FIG. 5 is a side view of pliable bag 19.

As shown more particularly in FIG. 5, an insulated, waterproof, generally pliable or plastic bag 19 for holding the fluid to be dispensed is provided which defines an open volume 40 configured to receive a minimum of 108 fluid ounces. Pliable bag 19 comprises two sections of pliable plastic which are heat sealed along two vertical edges, a top edge, and a bottom preferably concave edge which defines a curved bottom to open volume 40, and is preferably comprised of pliable plastic which may withstand temperatures of up to 250° F. without degradation of the bag's integrity. Located between a vertical edge and the top edge of pliable bag 19 is weld spout area 19*a* which attaches to connecting section 18 on spout 15 to form an integral unit therewith, spout 15 in turn forming a dispensing outlet for the contents of pliable bag 19. As mentioned briefly above, pliable bag 19 and annular spout 15 are so connected into the supporting assembly 12 of the frame 11 and the spout holder 13 that the dispensing outlet 17 of annular spout 15 will be disposed exterior of frame 11 to enable a cover means 20 to be detachably connected to annular spout 15 about dispensing outlet 17. Openings 19*b* are provided within the heat-sealed region of bag 19, openings 19*b* being sized to allow the insertion of tabs 24 on support member 12*b*. When bag 19 is so attached to tabs 24, inadvertent movement of the bag with respect to the interior of frame 11 is largely diminished.

Figure 6B:
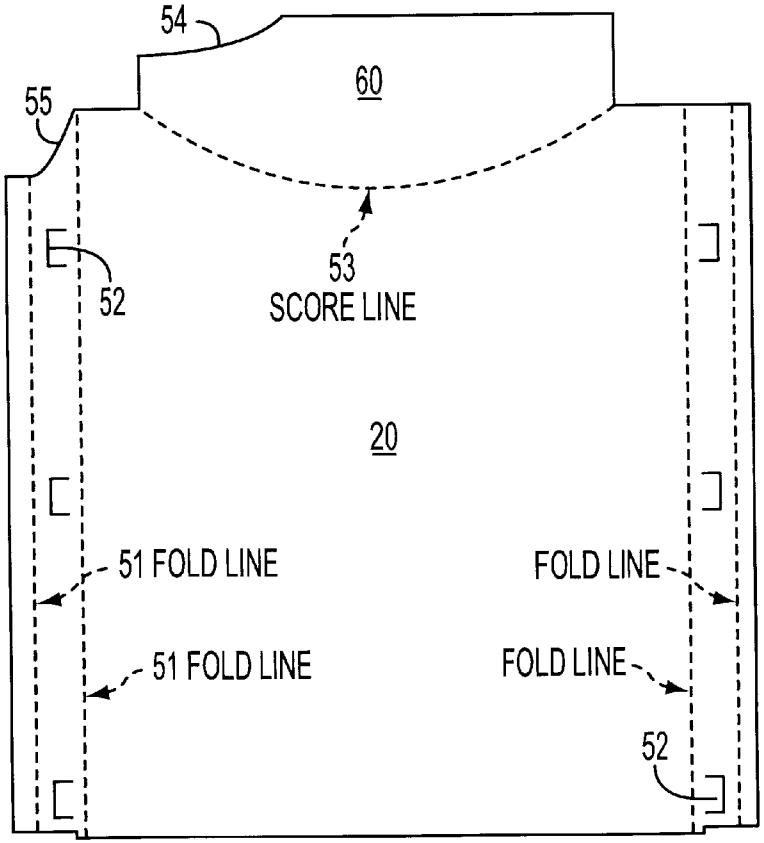
FIGS. 6*a* and 6*b* are side views of a right and left side panel of insulating jacket 20, respectively.
Figure 6A:
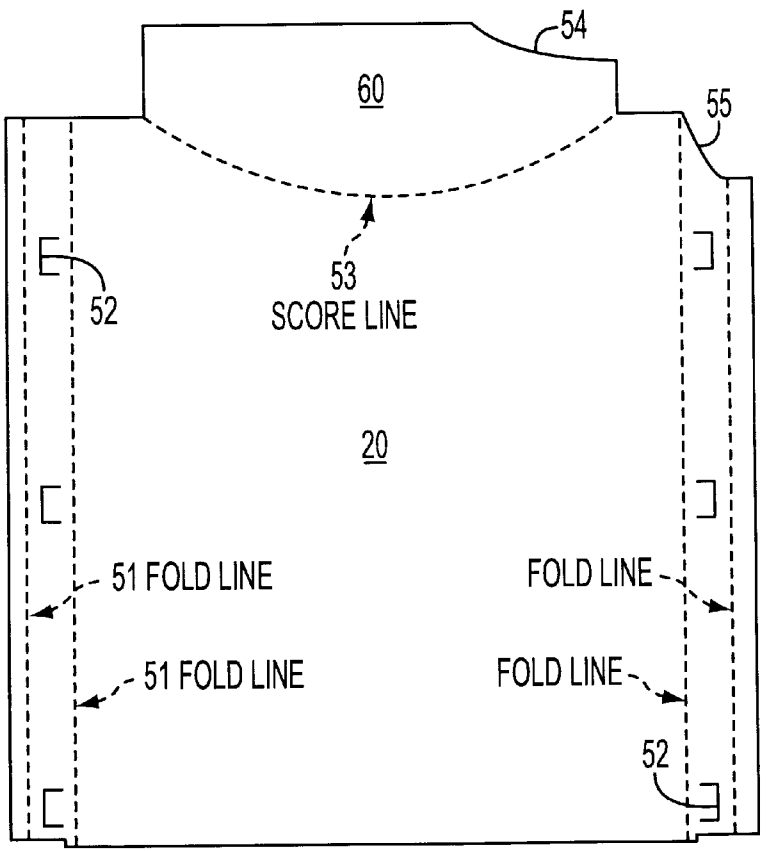
Figure 1:
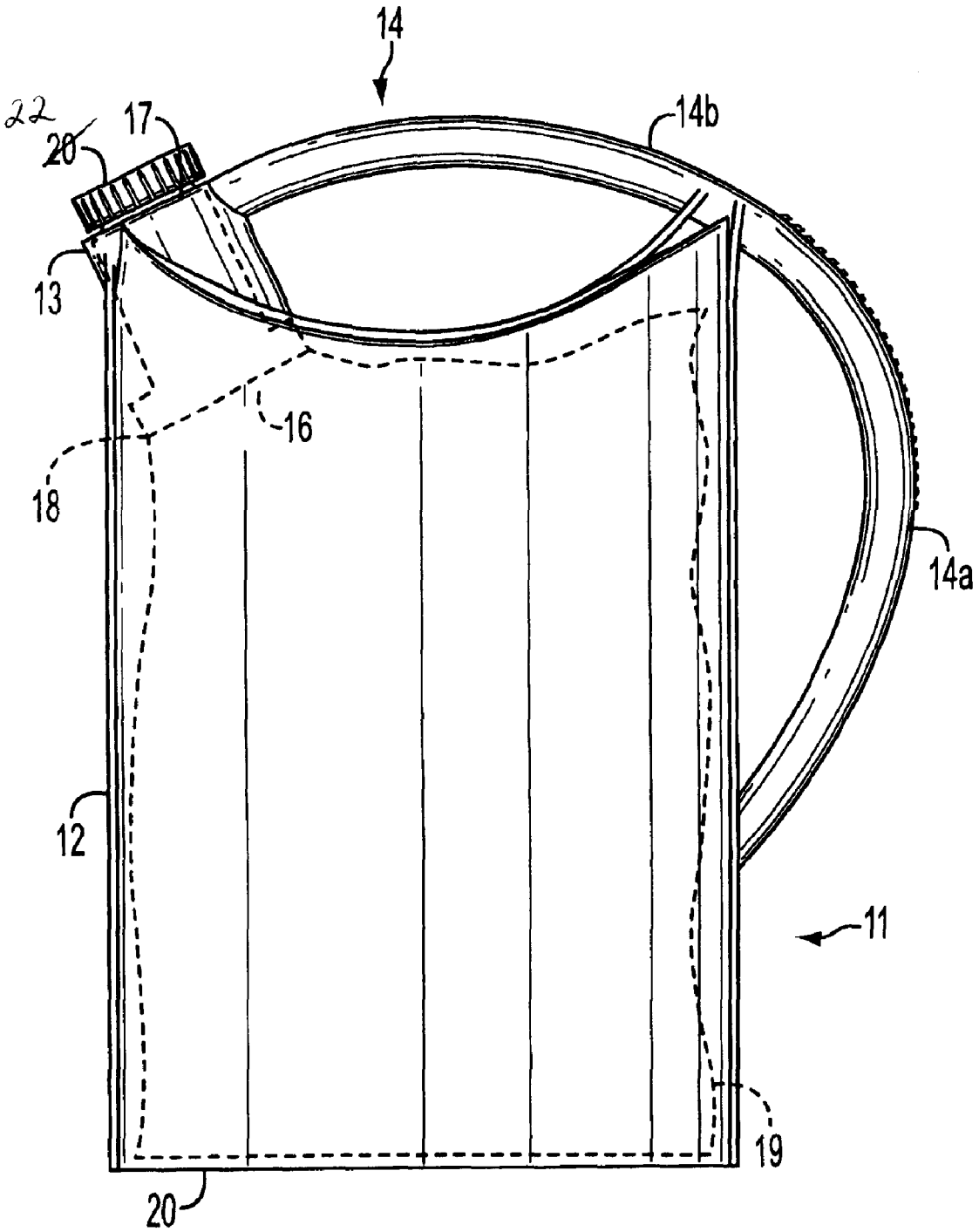

As shown in the right side and left side views of FIGS. 6*a* and 6*b*, respectively, jacket 20 comprises two planar sheets of insulating material configured to be attached to support assembly 12 about pliable bag 19 and spout holder 13 after the integral spout/bag unit is connected in assembled position on support assembly 12 of frame 11. FIGS. 6*a* and 6*b* are mirror images of one another, FIG. 6*a* depicting a side panel for the right side of the carafe, and FIG. 6*b* depicting a side panel for the left side of the carafe. Each side panel of jacket 20 has generally flat bottom, front, and rear edges. Both the front and rear edges of each side panel are provided with fold lines 51 to facilitate insertion of the front and rear edges of each side panel into clamping means 25 on frame 11. Although not particularly shown in FIGS. 6*a* and 6*b*, additional fold or score lines may be provided between the front and rear edges of each side panel in order to more easily enable side panels of jacket 20 to form curved exterior side walls for the carafe body.

Each of the side panels is also provide a series of perforated tabs 52 positioned adjacent the front and rear edges of each side panel. Perforated tabs 52 are spaced apart from one another the same distance as their corresponding ramps 25 on frame support member 12*b*, such that when each side panel edge is inserted into the gap 25*a* between ramps 25 and outer support member 12*a* and pushed towards frame support member 12*b*, ramps 25 break the perforations on each perforated tab 52. After the perforations are broken, the interior edge of each ramp 25 will engage the leading edge of the opening in the side panels formed from the separated tab 52 so as to prevent the front and rear edges of the side panels from being inadvertently withdrawn from the frame.

Further, the top edge of each side panel is provided with a curved score line 53 which, when folded, forms a curved plane 60 defining a top edge of jacket 20 and abutting the top edge of frame 11. The upper, front comer of curved plane 60 is provided a cutout 54 enabling the front comer to lie flush against a side portion of spout holder 13. Likewise, the upper, front comer of each side panel is provided a cutout 55 enabling such front corner to lie flush against the bottom portion of spout holder 13.

Each side panel of jacket 20 is preferably formed of a pliable corrugated material such as single-faced corrugate, 130 lb. cover, enabling the side panels to provide an insulating surface protecting against inadvertent bums that might be caused by contacting pliable bag 19 directly. Moreover, the general planar form of each of the side panels of jacket 20, as well as the minimal thickness profile of rigid frame 11 other than the base, enables multiple, unassembled carafe units of the instant invention to be shipped and stored in a flat, stacked package, while enabling the same to take on a rounded, full-volume, original carafe appearance when assembled.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

What is claimed is:

1. A disposable storage and dispensing carafe comprising:

a frame, said frame having a spout holder;

a flexible bag having an outlet opening;

a spout having an inlet opening and an outlet opening, said inlet opening being fixedly attached to said outlet opening of said flexible bag;

said spout and said flexible bag being detachably connected to said frame whereby said spout is detachably held within said spout holder and said flexible bag is detachably held within an interior of and circumscribed by said frame; and an insulating jacket detachably connected to said frame and circumscribing said flexible bag.

2. The disposable storage and dispensing carafe of claim 1, said frame further comprising a first handle for carrying said carafe in an upright position, and a second handle for manipulating said carafe to dispense contents therefrom.

3. The disposable storage and dispensing carafe of claim 2, said first handle further comprising a first elongate rigid member having a first end rigidly attached to a first point on a top wall of said frame, and a second end rigidly attached to said spout holder, and said second handle further comprising a second elongate rigid member having a first end rigidly attached to a first point on a side wall of said frame, and a second end rigidly attached to a second point on said side wall of said frame.

4. The disposable storage and dispensing carafe of claim 1, said frame further comprising:

a first support member having a top, a bottom, and two sides;

a second support member having a top, a bottom, and two sides, said second support member circumscribing said first support member; and a web of material rigidly attached to and positioned between said first and second support members so as to hold said first and second support members in circumscribing configuration.

5. The disposable storage and dispensing carafe of claim 4, said first support member further comprising a plurality of clamping devices configured to detachably hold said insulating jacket.

6. The disposable storage and dispensing carafe of claim 4, said flexible bag further comprising a plurality of openings positioned along a periphery of said bag, and said first support member further comprising a plurality of tabs configured to engage said openings on the periphery of said bag so as to detachably hold said flexible bag within said frame.

7. The disposable storage and dispensing carafe of claim 4, said spout holder extending through both said first and second support members.

8. The disposable storage and dispensing carafe of claim 1, said spout holder further comprising:

an elongate channel having a rigid exterior wall defining a generally annular passage extending from an interior of said frame to an exterior of said frame, said wall having an upper end corresponding to the exterior of the frame, and a lower end corresponding to the interior of the frame; and a resilient tab formed in said exterior wall adjacent said lower end configured for movement into and away from said annular passage and biased towards an at-rest position in which said tab lies within a plane defined by an exterior of said exterior wall, said resilient tab configured to detachably hold said spout in said spout holder.

9. The disposable storage and dispensing carafe of claim 8, said resilient tab further comprising a hook extending into said annular passage, said hook being configured to engage a surface on said spout so as to prevent movement of said spout in a direction towards the interior of said frame.

10. The disposable storage and dispensing carafe of claim 1, said spout further comprising an elongate, generally annular shaft configured for insertion into said spout holder such that an upper portion of said spout corresponding to said outlet end extends above said spout holder.

11. The disposable storage and dispensing carafe of claim 10, said spout holder further comprising a resiliently positionable hook, and said spout further comprising a guide flange positioned along an exterior wall of said spout, said guide flange terminating in an abutment attached to the exterior wall of said spout, said guide flange being configured to guide said hook on said spout holder away from said spout during insertion of said spout into said spout holder, and said abutment being configured to engage said hook when said spout is fully inserted into said spout holder so as to prevent movement of said spout in a direction towards the interior of said frame.

12. The disposable storage and dispensing carafe of claim 11, said spout holder further comprising a positioning flange, and said spout further comprising a guide channel sized to receive said positioning flange upon insertion into said spout holder so as to maintain said guide flange on said spout with said hook on said spout holder.

13. The disposable storage and dispensing carafe of claim 1, said frame further comprising a plurality of tabs extending into the interior of said frame, and said flexible bag further comprising:

two facing flexible panels, said flexible panels being affixed to one another along a periphery thereof so as to define a water-tight compartment therebetween having a single unsealed portion defining said outlet opening; and a plurality of openings positioned along said heat-sealed periphery, said openings being configured to engage said tabs on said frame so as to detachably hold said flexible bag within said frame.

14. The disposable storage and dispensing carafe of claim 13, said flexible bag being configured to hold at least 108 fluid ounces.

15. The disposable storage and dispensing carafe of claim 1, said insulating jacket further comprising:

at least one flexible, corrugated sheet, said sheet having attaching means for attaching said sheet to said frame.

16. The disposable storage and dispensing carafe of claim 15, said sheet having a front edge, a rear edge, a top edge, and a bottom edge, and said attaching means further comprising a plurality of perforated tabs adjacent each of said front edge and said rear edge, said perforated tabs being configured to engage a plurality of ramps on said frame so as to detachably connect said sheet to said frame.

17. A disposable storage and dispensing carafe comprising:

a portable rigid frame;

a flexible bag having an outlet opening;

a spout fixedly attached to said outlet opening of said flexible bag;

an insulating jacket detachably connected to said frame and circumscribing said flexible bag; and means for detachably connecting said flexible bag and spout to said frame.

18. The disposable storage and dispensing carafe of claim 17, further comprising first means for carrying said carafe in an upright position, and second means for manipulating said carafe to dispense contents therefrom.

19. The disposable storage and dispensing carafe of claim 18, said first means further comprising a first handle extending between two points on a top wall of said frame, and said second means further comprising a second handle extending between two points on a side wall of said frame.

* * * * *

UNITED STATES PATENT AND TRADEMARK OFFICE

CERTIFICATE OF CORRECTION

PATENT NO. : 6,375,040 B1
APPLICATION NO. : 09/782827
DATED : April 23, 2002
INVENTOR(S) : Gary R. Allanson et al.

It is certified that error appears in the above-identified patent and that said Letters Patent is hereby corrected as shown below:

Drawings,
Sheet 1, Figure 1, the reference number "20" pointing to the cover for the dispensing outlet should be changed to -- 22 --.

Column 3,
Line 5, reference number "20", each occurrence, should read -- 22 --.

Column 4,
Line 33, reference number "20", each occurrence, should read -- 22 --.

Column 5,
Line 12, reference number "20", each occurrence, should read -- 22 --.

Signed and Sealed this

Twenty-seventh Day of June, 2006

JON W. DUDAS
*Director of the United States Patent and Trademark Office*